US006505754B1

(12) United States Patent
Kenny et al.

(10) Patent No.: US 6,505,754 B1
(45) Date of Patent: Jan. 14, 2003

(54) APPARATUS FOR AUTOMATED KEY RETRIEVAL AND DEPOSIT

(75) Inventors: Thomas A. Kenny, Troy, MI (US); Gerald T. McCabe, Clarkston, MI (US); Christopher P. Batts, Troy, MI (US); James R. Heim, Kalamazoo, MI (US)

(73) Assignee: Spectrum Composities, Inc., Sterling Heights, MI (US)

( * ) Notice: Subject to any disclaimer, the term of this patent is extended or adjusted under 35 U.S.C. 154(b) by 0 days.

(21) Appl. No.: 09/491,316

(22) Filed: Jan. 25, 2000

(51) Int. Cl.[7] ..... G07F 11/00

(52) U.S. Cl. ..... 221/13; 221/123; 221/124; 221/129; 221/133; 221/151; 221/268; 221/272; 221/306

(58) Field of Search ..... 221/2, 5, 13, 123, 221/124, 125, 129, 133, 151, 152, 268, 272, 282, 285, 312 A, 306; 700/231, 237

(56) References Cited

U.S. PATENT DOCUMENTS

| | | | | | |
|---|---|---|---|---|---|
| 4,519,522 | A | * | 5/1985 | McElwee | 534/554 |
| RE32,115 | E | | 4/1986 | Lockwood et al. | |
| 4,631,358 | A | * | 12/1986 | Newcome et al. | 379/102.06 |
| 4,661,806 | A | * | 4/1987 | Peters et al. | 340/568.1 |
| 4,681,504 | A | | 7/1987 | Welch, Sr. | |
| 4,752,876 | A | | 6/1988 | Couch et al. | |
| 4,803,348 | A | | 2/1989 | Lohrey et al. | |
| 4,812,985 | A | | 3/1989 | Hambrick et al. | |
| 5,025,140 | A | | 6/1991 | Varley | |
| 5,088,586 | A | * | 2/1992 | Isobe et al. | 194/205 |
| 5,113,351 | A | | 5/1992 | Bostic | |
| 5,172,829 | A | | 12/1992 | Dellicker, Jr. | |
| 5,205,436 | A | | 4/1993 | Savage | |
| 5,212,649 | A | | 5/1993 | Pelletier et al. | |
| 5,251,782 | A | * | 10/1993 | Crosby et al. | 221/2 |
| 5,344,042 | A | | 9/1994 | Crosby et al. | |
| 6,056,152 | A | * | 5/2000 | Gonzalez | 15/88.3 |

* cited by examiner

*Primary Examiner*—Khoi H. Tran
(74) *Attorney, Agent, or Firm*—Gifford, Krass, Groh, Sprinkle, Anderson & Citkowski, P.C.

(57) ABSTRACT

An apparatus for automated key retrieval and deposit includes a housing and a key storage rack assembly positioned within the housing. The automated key retrieval and deposit apparatus also includes a key holder for holding a key to be retrieved positioned on the key storage rack, and a key holder actuating mechanism operatively connected to the key holder, for actuating the key holder between an extended position and a retracted position. The automated key retrieval and deposit apparatus further includes a cover pivotally connected to the key storage rack and actuatable between a closed position and an open position, wherein the cover, in the closed position, exerts a force on the keyholder to retain the key on the key holder.

23 Claims, 3 Drawing Sheets

APPARATUS FOR AUTOMATED KEY RETRIEVAL AND DEPOSIT

TECHNICAL FIELD

The present invention relates generally to a method and apparatus for retrieval and deposit and, more particularly, to a method and apparatus for automated key retrieval and deposit.

BACKGROUND OF THE INVENTION

It is known to provide an automated device for retrieval and deposit of an item. In a servive-oriented business, such as a hotel, automobile rental agency, automobile dealership, or automotive vehicle repair shop, the ability to retrieve or deposit a door actuator, such as a key, at the customer's convenience is a valuable asset.

For example, a customer leaves their vehicle and its key at an automotive vehicle repair shop, in order to receive a service, and then retrieves the key and vehicle after the service is complete. It is desirable for the customer to have the ability to either drop off the vehicle or retrieve the vehicle at their convenience. However, the customer's schedule may not coincide with the business hours of the automotive vehicle repair shop. To accommodate the needs of their customers, automotive vehicle repair shops frequently provide an externally located after-hours drop box, allowing the customer to drop the vehicle off and deposit the vehicle keys within the drop box. A disadvantage of an after-hours drop box is that its use is limited to dropping off the vehicle, and not retrieving the keys and locating the vehicle.

An automated device for dispensing a key provides a customer with access to the key at their convenience. One example of an automated key dispenser is disclosed in U.S. Pat. No. 5,172,829 to Dellicker, Jr., and dated Dec. 22, 1992. Dellicker, Jr. '829 discloses an automated key dispenser that includes a housing for storing one or more racks. Each rack includes a plurality of moveable pins arranged in a horizontal and vertical array and in one plane. A key hangs from the pin. An awning-shaped cover positioned over a row of pins has two functions, to operatively deflect a key being released, and to operatively retain a stored key on the pin. This automated key dispenser suffers the disadvantage that the released key may become tangled with or dislodge another stored key in a lower row as it drops, since the keys stored on the rack are arranged in one plane. Another disadvantage is that the awning-shaped cover integrally retains the key on the pin. Thus, there is a need in the art to provide a methodology and apparatus for automated key retrieval and deposit that provides for the retrieval of a key without disturbing another key stored within.

SUMMARY OF THE INVENTION

It is one object of the present invention to provide an apparatus for automated key retrieval and deposit that has the keys arranged so that the key being retrieved does not interfere with another stored key.

It is another object of the present invention to provide a method of automated key retrieval and deposit.

To achieve the foregoing objects, the present invention is a method and apparatus for automated key retrieval and deposit. The apparatus includes a housing and a key storage rack assembly positioned within the housing, wherein the key storage rack assembly includes at least one key storage rack. The automated key retrieval and deposit apparatus also includes a key holder for holding a key to be retrieved positioned on the key storage rack, and a key holder actuating mechanism operatively connected to the key holder, for slidably actuating the key holder between an extended position for holding the key to be retrieved and a retracted position for releasing the key to be retrieved. The automated key retrieval and deposit apparatus further includes a generally planar cover pivotally connected to the key storage rack and actuatable between a closed position and an open position, wherein the cover in the closed position exerts a force on the keyholder to retain the key on the keyholder.

The method includes the steps of placing a key to be retrieved on a key holder within the automated key retrieval and deposit apparatus by an operator, and storing an access code identifying the key holder in a controller operatively connected to the key holder by an operator. The method also includes the steps of entering an access code into the controller by a user and determining if the entered access code is the same as the stored access code. The method further includes the steps of releasing the key to be retrieved from the key holder identified by the stored access code, if the entered access code is the same as the stored access code.

One advantage of the present invention is that a method and apparatus for automated key retrieval and deposit is provided that allows a key to be deposited and securely retained within the apparatus. Another advantage of the present invention is that the method and apparatus for automated key retrieval and deposit allows for retrieval of a particular key, if a predetermined condition is satisfied. Still another advantage of the present invention is that a key being retrieved from the apparatus for automated key retrieval and deposit does not contact another stored key during retrieval. Yet still another advantage of the present invention is that the method and apparatus for automated key retrieval and deposit is interactive with an operator or a user. A further advantage of the present invention is that the method and apparatus of automated key retrieval and deposit only allows the key to be retrieved if a predetermined condition is right to release the key.

Other objects, features and advantages of the present invention will be readily appreciated, as the same becomes better understood after reading the subsequent description taken in conjunction with the accompanying drawings.

DESCRIPTION OF THE PREFERRED EMBODIMENT

Figure 1:
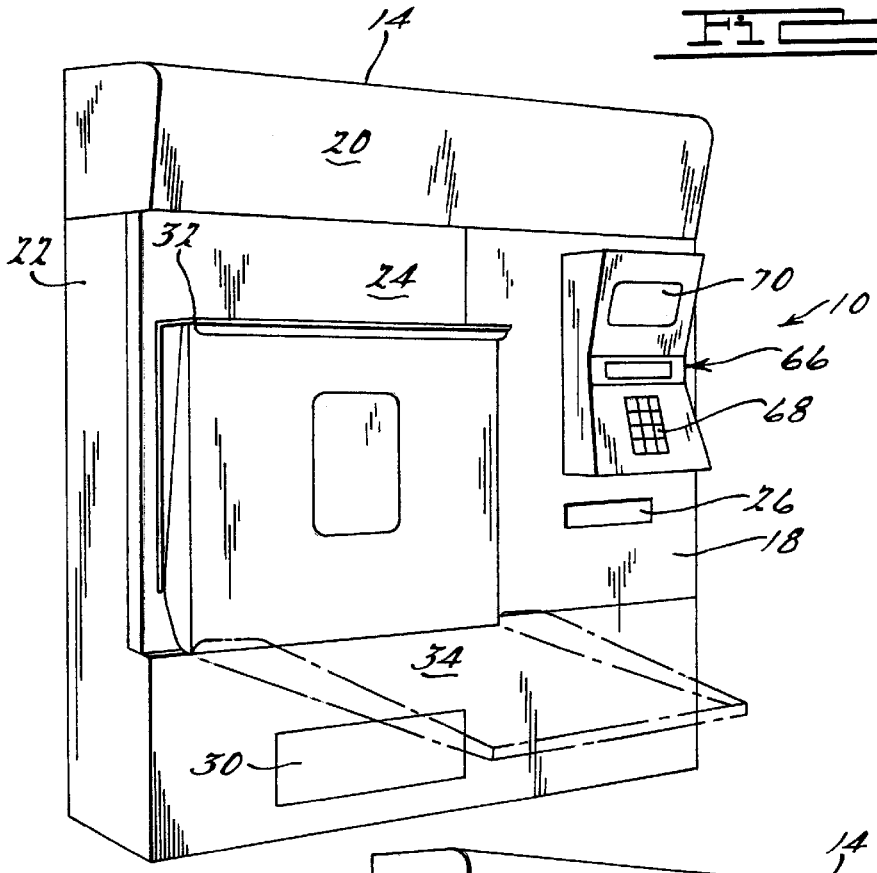
FIG. 1 is a front perspective view of an apparatus for automated key retrieval and deposit according to the present invention.
Figure 2:
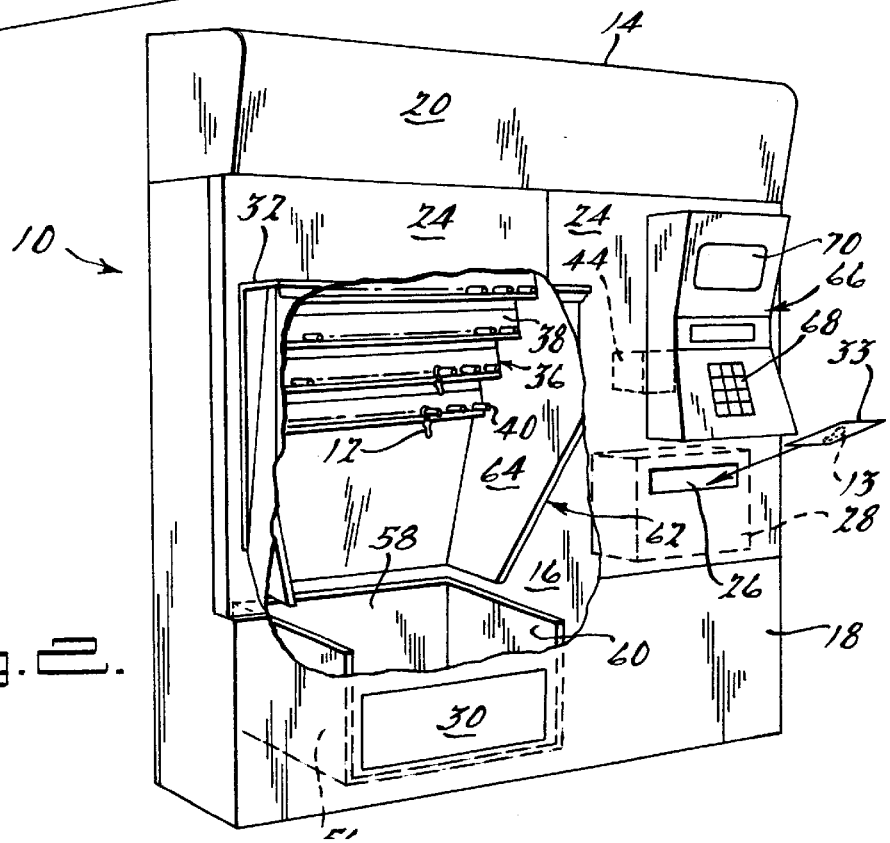
FIG. 2 is a partially cut-away front perspective view illustrating an interior portion of the apparatus for automated key retrieval and deposit of FIG. 1.

Referring to the drawings and in particular FIGS. 1 and 2, an apparatus for automated key retrieval and deposit 10 is illustrated. The automated key retrieval and deposit apparatus 10 is an interactive device that allows for the retrieval of an item such as a key 12, if a predetermined condition is met to release the key to be retrieved 12. The automated key retrieval and deposit apparatus 10 also provides for storage of a key to be deposited 13, which may be in an envelope. In this example, the keys 12, 13 are an actuator for a door (not shown) on an automotive vehicle, (not shown) that is stamped from a metal material, although other types of keys 12, 13 are contemplated. It is also contemplated that the key to be retrieved 12, or key to be deposited 13 may be connected to a key chain assembly (not shown) for holding a plurality of keys 12, 13.

The automated key retrieval and deposit apparatus 10 may be used in conjunction with a business such as an automotive vehicle repair shop in this example. The automated key retrieval and deposit apparatus 10 interacts with both an operator (not shown, such as a representative of the automotive vehicle repair shop, and a user (not shown) , such as a customer of the automotive vehicle repair shop. Advantageously, the automated key retrieval and deposit apparatus 10 may be secured on a wall or mounted to a stand, where it is accessible by either the operator or user.

The automated key retrieval and deposit apparatus 10 includes a housing 14, generally indicated at 14, for housing components of the automated key retrieval and deposit apparatus 10. The housing 14 includes an interior portion 16 and an exterior portion 18. The housing 14 is generally rectangular, and includes a front 20, back (not shown) and side 22 portions that cooperatively fit together to form a box structure. It should be appreciated that the exterior portion 18 of the housing 14 may include indicia (not shown), such as a logo or the like secured to it. The housing 14 includes an access door 24 allowing access to the interior portion 16 of the housing 14 and the components located within. In this example, there are two access doors 24 in the front portion 20.

The housing 14 also includes a key deposit door 26 integrally formed in the housing 14. The key deposit door 26 provides an entry way for a key to be deposited 13 to be stored within a key deposit box 28, to be described. In this example, the key deposit door 26 is located in the front portion 20 of the housing 14.

The key deposit box 28 is positioned within the interior portion 16 of the housing 14. The key deposit box 28 is in communication with the key deposit door 26 and provides for storage of a key to be deposited 13 by a user. Advantageously, the user cannot access the contents of the key deposit box 28 through the key deposit door 26. However, the key deposit box 28 is accessible by an operator (not shown) through the access door 24 to obtain the key to be deposited 13 stored therein. Preferably, the automated key retrieval and deposit apparatus 10 includes a safety wall (not shown) positioned in the interior portion of the housing 14 between the housing 14 and the key deposit box 28, to provide added protection for the contents of the key deposit box 28 from tampering or the like.

The housing 14 further includes a key retrieval door 30 integrally formed in the housing 14 for allowing the user access only to the key to be retrieved 12 from the automated key retrieval and deposit apparatus 10. In this example, the key retrieval door 30 is located in the front portion 20 of the housing 14. Advantageously, the key retrieval door 30 provides access to only a key 12 positioned within a key retrieval box 56 (to be described).

The automated key retrieval and deposit apparatus 10 includes a supply box 32 positioned on the exterior portion 18 of the housing 14. In this example, the supply box 32 is located on one of the access doors 24 and has a generally rectangular shape. Preferably, the supply box 32 holds supplies such as envelopes 33 for packaging the key to be deposited 13 or a pen (not shown) for including written information on the envelope 33. A lower edge of a front portion 34 of the supply box 32 may be hingeably attached to the supply box 32. Advantageously, in an open position, the front portion 34 of the supply box 32 provides access to any supplies stored therein. In addition, the open front portion 34 provides a writing surface for including written information on the envelope 33. A user can place the key to be deposited 13 in the envelope 33, and push the envelope 33 through the key deposit door 26, where it falls into the key deposit box 28.

Figure 3:
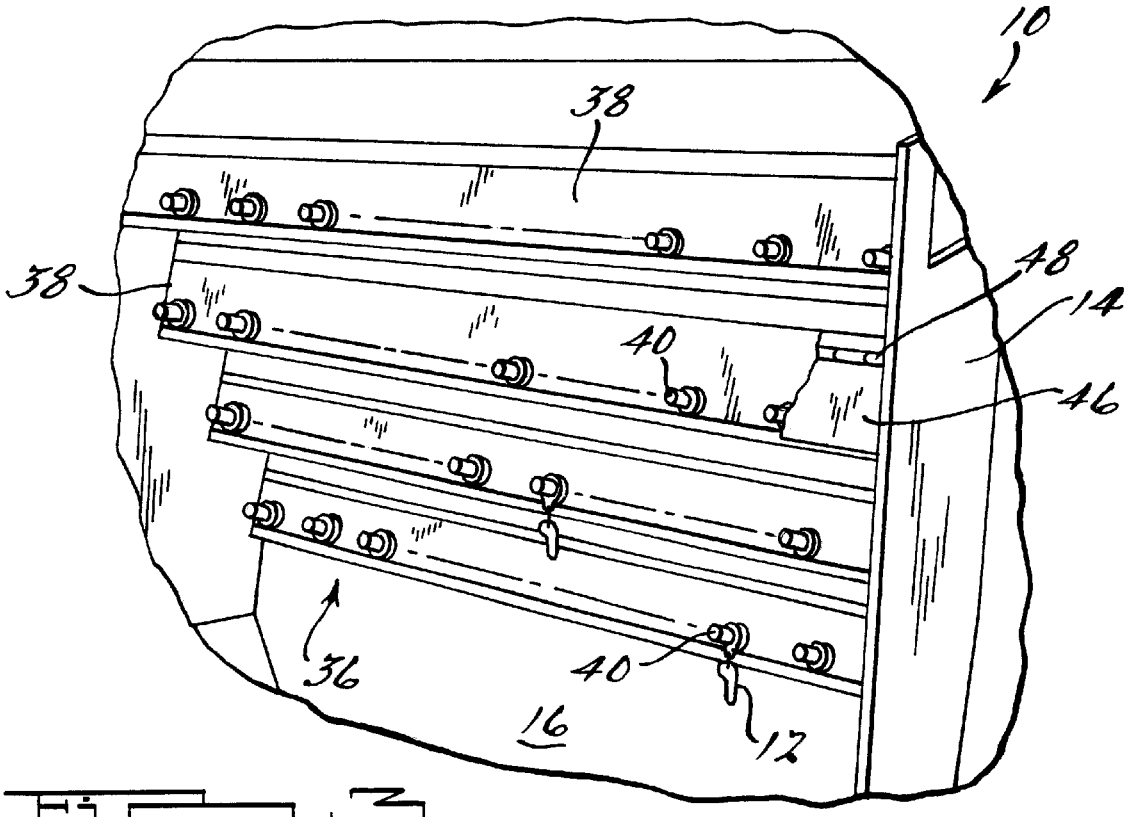
FIG. 3 is a front perspective view of a key storage rack assembly within the apparatus for automated key retrieval and deposit of FIG. 2.
Figure 4:
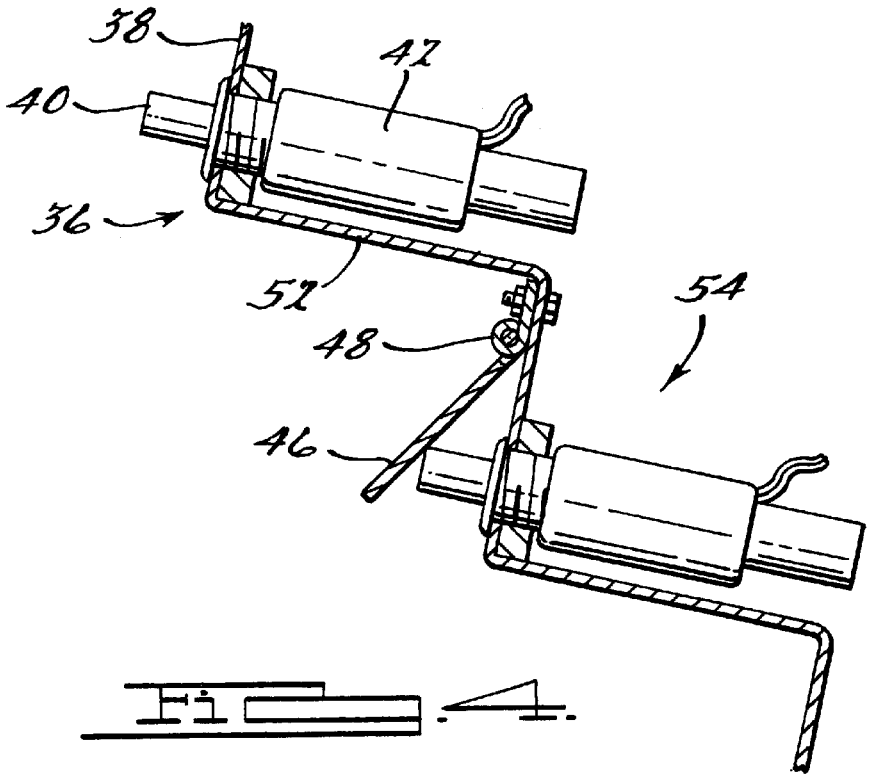
FIG. 4 is a side view of the key storage rack assembly of FIG. 3.

As shown in FIGS. 3 and 4, the automated key retrieval and deposit apparatus 10 includes a key storage rack assembly 36 fixedly retained within the interior portion 16 of the housing 14. The key storage rack assembly 36 includes at least one key storage rack 38 that is generally planar and extends longitudinally a sufficient amount. The key storage rack 38 is generally rectangular in shape, and includes a plurality of key holders 40 for holding a key to be retrieved 12 arranged axially along the key storage rack 38. Each key holder 40 extends radially from the key storage rack 38 to provide a support for a key to be retrieved 12. In this example, the key holder 40 is a cylindrically shaped peg that is slidably actuated by a key holder actuating mechanism 42, in a manner to be described. It should be appreciated that the key holder 40 may also be a hook, or pin, or the like, for retaining the key to be retrieved 12. Preferably, the key storage rack 38 includes indicia (not shown) such as a number associated with each key holder 40, to distinguish one key holder 40 from another, for a purpose to be described.

The key storage rack 38 includes a key holder actuating mechanism 42 operatively connected to the key holder 40, to slidably retract and extend the key holder 40. The key holder actuating mechanism 42 slidably retracts the key holder 40 inwards, to release the key to be retrieved 12 from the key holder 40. The key holder actuating mechanism 42 slidably returns the key holder 40 to its outwardly extending position after it has been retracted. Preferably, there is one key holder actuating mechanism 42 associated with each key holder 40. In this example, the key holder actuating mechanism 42 is a solenoid, as is understood in the art. The actuation of the key holder actuating mechanism 42 is controlled by a controller 44, in a manner to be described.

The key storage rack 38 includes a moveable cover 46 that acts as a shield for the key holders 40. The cover 46 extends longitudinally along the key storage rack 38 a sufficient amount, and has a generally planar and rectangular shape. The cover 46 includes a retaining mechanism 48 extending therealong an upper edge of the cover 46. The retaining mechanism 48 retains the cover 46 in a closed position while allowing the cover 46 to be forcibly opened away from the key holder 40 by the operator, to provide access to the keyholder. Preferably, the retaining mechanism 48 is a spring hinge, as is known in the art.

It should be appreciated that the cover 46 exerts a force on the key holder 40 to retain the key 12 on the key holder 40. Advantageously, the force of the cover 46 on the key holder 40 protects another key to be retrieved 12 on another key holder 40 from being accidentally dislodged as the key to be retrieved 12 is released.

The key storage rack assembly 36 may include a plurality of key storage racks 38 arranged in separate horizontal and vertical planes, preferably in a stepped arrangement. In this example, the uppermost key storage rack 38 is in the forwardmost position, and the lowermost key storage rack 38 is in the rearwardmost position, relative to the back portion of the housing 14. A sufficient horizontal distance is allowed between each key storage rack 38, so that a key to be retrieved 12 does not interfere with another key to be retrieved 12 located on another key storage rack 38, as the key to be retrieved 12 is falling into the key retrieval box 56.

Advantageously, the stepped arrangement of the key storage racks 38 in the key storage rack assembly 36 protects another key to be retrieved 12 located on another key storage rack 38 from being accidentally dislodged, since there is no contact between the keys. It should be appreciated that the key storage racks 38 may be interconnected by a connecting member 52. The connecting member 52 is generally planar and rectangular in shape.

Preferably, the connecting member 52 interconnects the key storage racks 38 to form an integral and unitary key storage rack assembly 36.

Referring back to FIG. 2, the automated key retrieval and deposit apparatus 10 includes a key retrieval box 56 positioned within the interior portion 16 of the housing. In this example, a top side 58 and a front side 60 of the key retrieval box 56 is open. The key retrieval box 56 is positioned so that the open top side 58 is aligned with the key storage rack 36, so that a key 12 being retrieved falls through the open top side 58 and into the key retrieval box 56. The key retrieval box 56 is also positioned with the open front side 60 aligned with the key retrieval door 30, so that a key to be retrieved 12 located in the key retrieval box 56 can be removed through the key retrieval door 30, and other keys stored in the key retrieval and deposit apparatus 10 are inaccessible.

The automated key retrieval and deposit apparatus 10 further include a chute 62 located within the housing 14. The chute 62 includes one or more generally planar members 64 that cooperatively form a pathway for directing the key to be retrieved 12 into the key retrieval box 56. The chute 62 is positioned between the key retrieval box 56 and the key storage rack 36.

The automated key retrieval and deposit apparatus 10 includes a controller 44 located within the housing 14 for controlling the operation of the automated key retrieval and deposit apparatus 10. The controller 44 includes a microprocessor, as is known in the art. The microprocessor is operatively connected to an interactive device 66, such as a keypad 68 and display device 70. The controller 44 may also be operatively connected to another device such as a microprocessor, interactive device or printer, remotely positioned from the automated key retrieval and deposit apparatus 10. Preferably, the display device 70 and keypad 68 are mounted on the exterior portion 18 of the housing 14, preferably on the front portion 20. The keypad 68 allows an operator or user to interact with the controller 44, in a manner to be described.

In operation, an operator places a key to be retrieved 12 by the user, on a key holder 40. The operator assigns the key holder 40 a predetermined condition to be met for the key to be retrieved 12, such as an access code. The operator inputs the access code for a corresponding key holder 40 and a set of information for the user into the controller 44 using the keypad 68 or a remote access device (not shown) when prompted to do so by instructions stored within the controller 44 and displayed on the display device 70. The information input by the operator may include a set of instructions for the user or a message relevant to a particular user. The instructions may be specific, wherein other data and instructions non-specific to the apparatus 10 may be already stored in the microprocessor.

A user desiring to release a key to be retrieved 12 is able to do so if the predetermined condition to retrieve a particular key is met. An example of a predetermined condition is if the entry of an access code by the user into the controller 44 corresponds with an access code stored in the controller 44 by the operator for a specific key holder 40. For example, a user enters an access code into the controller 44 via the keypad 68. If the entered access code matches the stored access code for a key holder 40, the key holder 40 corresponding to the stored access code slidably retracts, and the key to be retrieved 12 falls through the chute 62 and into the key retrieval box 56. The user can access the key to be retrieved 12 through the key retrieval door 30.

Figure 5:
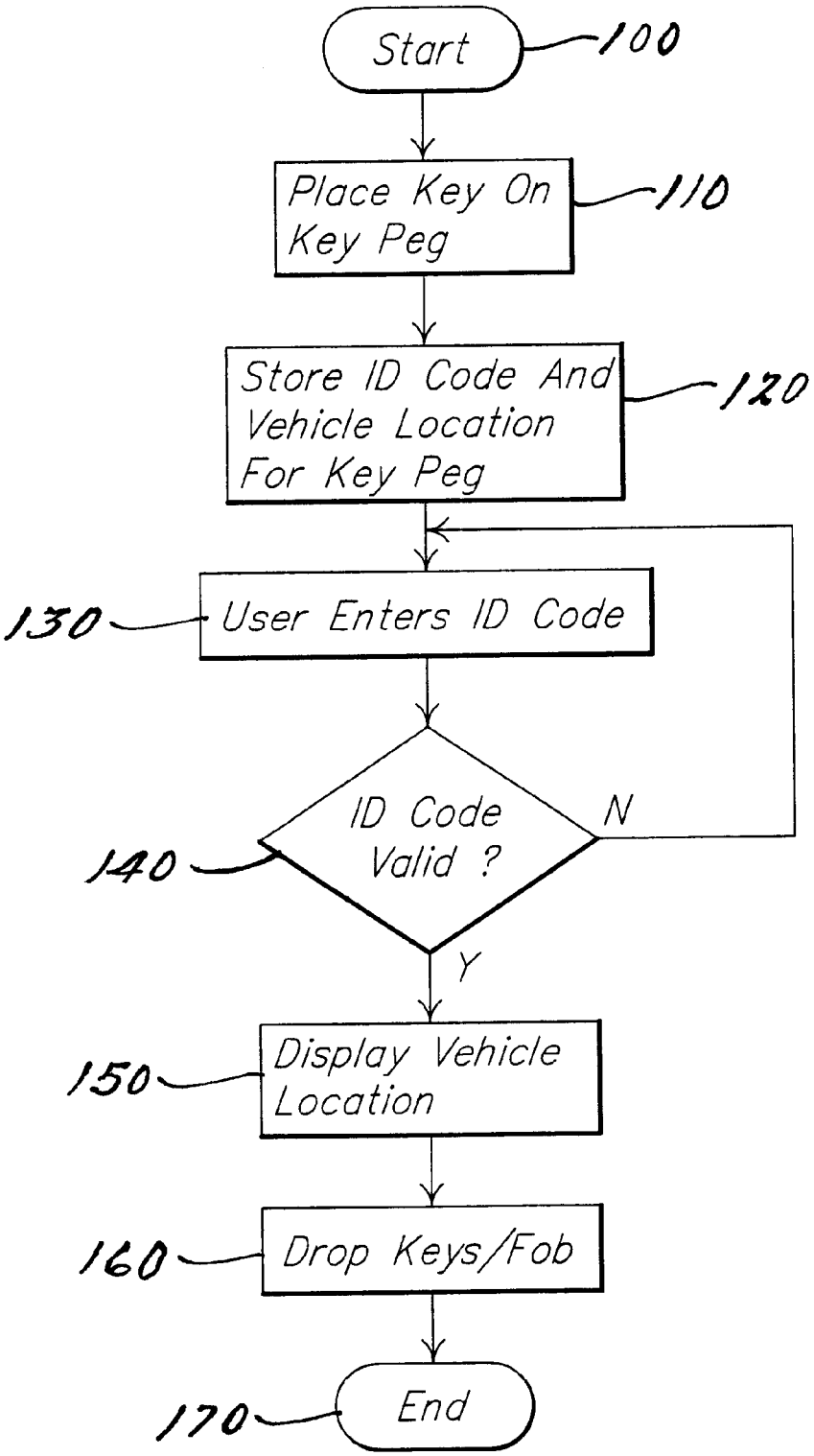
FIG. 5 is a method of automated key retrieval and deposit, according to the present invention, for the automated key retrieval and deposit apparatus of FIG. 1.

Referring to FIG. 5, a method, according to the present invention, for automated key retrieval and deposit 10 is illustrated. The methodology begins in bubble 100 and continues to block 110. In block 110 an operator, as previously described, places a key to be retrieved 12 on a key holder 40 in the automated key retrieval and deposit apparatus 10. It should be appreciated that the key to be retrieved 12 corresponds with a particular vehicle positioned in a particular location.

The methodology advances to block 120, and the operator enters a predetermined condition, such as an access code, into the memory of the controller 44 corresponding with the particular key holder 40 holding the key to be retrieved 12. The operator also enters information such as a set of instructions for the user, a message to the user, including the location of the vehicle corresponding with the key to be retrieved 12 positioned on the key holder 40. The information may also be in the form of questions for the user. One example of a question for the user is if the user is satisfied with the service performed. Advantageously, the user may reply via the keypad 68, and the user's response is stored in the controller 44, and is accessible by the operator at a later time.

The methodology advances to block 130 and a user enters an access code into the controller 44 via the keypad 68. The methodology advances to diamond 140. In diamond 140 the methodology determines if the predetermined condition is met to release the key to be retrieved 12. In this example, the predetermined condition is whether the access code entered by the user matches the access code stored in the controller 44 by the operator for the particular key holder 40. If the entered access code does not match the stored access code, the predetermined condition is not met, implying that the entered access code is not valid, and the methodology returns to block 130. It should be appreciated that the user may be allowed to enter the access code a predetermined number of times, such as 3. If the entered access code does not match the stored access code after the predetermined number of times, the methodology advances to block 170 and ends.

If the predetermined condition is met, because the entered access code does match the stored access code, the access code is valid, and the methodology advances to block 150. In block 150, the methodology displays information stored within the controller 44, such as a message to the user as previously described, on the display device 70. The methodology advances to block 160. In block 160, the controller 44 directs the key holder actuating mechanism 42 to slidably retract the key holder 40. As a result, the key to be retrieved 12 is displaced from the key holder 40, and the key to be retrieved 12 drops through the chute 62 and into the key retrieval box 56. The user may then remove the key to be retrieved 12 from the key retrieval box 56 through the key retrieval door 30.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An automated key retrieval and deposit apparatus comprising:

a housing;

a key storage rack assembly positioned within the housing wherein said key storage rack assembly includes at least one key storage rack;

a key holder for holding a key to be retrieved positioned on said key storage rack;

a key holder actuating mechanism operatively connected to said key holder, for slidably actuating said key holder between an extended position for holding the key to be retrieved and a retracted position for releasing the key to be retrieved; and a generally planar cover pivotally connected to said key storage rack and actuatable between a closed position and an open position, wherein said cover in the closed position exerts a force on said keyholder to retain the key on said key holder.

2. An automated key retrieval and deposit apparatus as set forth in claim 1 wherein said housing includes an access door to provide access to an interior portion of said housing.

3. An automated key retrieval and deposit apparatus as set forth in claim 1 wherein said housing includes a key deposit door integrally formed in the housing for inserting a key to be deposited within the automated key retrieval and deposit apparatus.

4. An automated key retrieval and deposit apparatus as set forth in claim 3 including a key deposit box positioned within said housing and in communication with said key deposit door for storing said key to be deposited.

5. An automated key retrieval and deposit apparatus as set forth in claim 1 including a supply box positioned on an exterior portion of the housing, wherein a front portion of said supply box is movable between an open position and a closed position.

6. An automated key retrieval and deposit apparatus as set forth in claim 1 including a key retrieval door integrally formed in said housing for accessing the key to be retrieved.

7. An automated key retrieval and deposit apparatus as set forth in claim 6 including a key retrieval box positioned within an interior portion of the housing in alignment with said key storage rack assembly, for receiving the key to be retrieved.

8. An automated key retrieval and deposit apparatus as set forth in claim 7 including a chute positioned between said key retrieval box and said key storage rack assembly for directing the key to be retrieved into said key retrieval box.

9. An automated key retrieval and deposit apparatus as set forth in claim 1, wherein said key storage rack is generally planar with a plurality of key holders spaced axially along said key storage rack.

10. An automated key retrieval and deposit apparatus as set forth in claim 9, wherein said key storage rack assembly includes a plurality of key storage racks located in separate vertical planes in a stepped arrangement.

11. An automated key retrieval and deposit apparatus as set forth in claim 10 wherein said plurality of key storage racks are integral and formed as one.

12. An automated key retrieval and deposit apparatus as set forth in claim 1 including a controller, wherein the controller directs said key holder actuating mechanism to retract said key holder and release the key to be retrieved.

13. An automated key retrieval and deposit apparatus comprising:

a housing;

a key storage rack assembly positioned within the housing, wherein said key storage rack assembly includes a plurality of generally planar key storage racks located in separate vertical planes in a stepped arrangement;

a plurality of key holders for holding a key to be retrieved spaced axially along said key storage racks;

a key holder actuating mechanism operatively connected to said key holders, for slidably actuating said key holders between an extended position for holding the key to be retrieved and a retracted position for releasing the key to be retrieved; and a generally planar cover pivotally connected to said key storage rack and actuatable between a closed position and an open position, wherein said cover in the closed position shields said key holders from the key to be retrieved.

14. An automated key retrieval and deposit apparatus as set forth in claim 13 wherein said housing includes an access door to provide access to an interior portion of said housing.

15. An automated key retrieval and deposit apparatus as set forth in claim 13 wherein said housing includes a key deposit door integrally formed in the housing for inserting a key to be deposited within the automated key retrieval and deposit apparatus.

16. An automated key retrieval and deposit apparatus as set forth in claim 15 including a key deposit box positioned within said housing and in communication with said key deposit door for storing the key to be deposited.

17. An automated key retrieval and deposit apparatus as set forth in claim 13 including a supply box positioned on an exterior portion of the housing, wherein a front portion of said supply box is movable between an open position and a closed position.

18. An automated key retrieval and deposit apparatus as set forth in claim 13 including a key retrieval door integrally formed in said housing for accessing the key to be retrieved.

19. An automated key retrieval and deposit apparatus as set forth in claim 18 including a key retrieval box positioned within an interior portion of the housing in alignment with said key storage rack, for receiving the key to be retrieved.

20. An automated key retrieval and deposit apparatus as set forth in claim 19 including a chute positioned between said key retrieval box and said key storage rack for directing the key to be retrieved into said key retrieval box.

21. An automated key retrieval and deposit apparatus as set forth in claim 13 wherein said plurality of key storage racks are integral and formed as one.

22. An automated key retrieval and deposit apparatus as set forth in claim 13 including a controller, wherein the controller directs said key holder actuating mechanism to retract said key holder and release the key being retrieved.

23. An apparatus for automated key retrieval and deposit as set forth in claim 13 including a retaining mechanism extending along an upper edge of said cover.

* * * * *